United States Patent [19]

Fujio

[11] Patent Number: 4,779,731

[45] Date of Patent: Oct. 25, 1988

[54] CLUSTER PACKAGE CONSTRUCTION WITH REINFORCING AND TEAR STRUCTURE

[76] Inventor: Masaaki Fujio, 15-8, Aoyamadai 3, Suita-shi, Osaks-fu, Japan

[21] Appl. No.: 848,340

[22] Filed: Apr. 4, 1986

Related U.S. Application Data

[63] Continuation of Ser. No. 682,323, Dec. 17, 1984, abandoned.

[30] Foreign Application Priority Data

Nov. 25, 1983 [JP] Japan ..... 58-181819[U]
Jan. 13, 1984 [JP] Japan ..... 59-3578[U]

[51] Int. Cl.[4] ..... B65D 71/08

[52] U.S. Cl. ..... 206/432; 206/497; 206/611; 206/613; 229/52 BC

[58] Field of Search ..... 206/427, 428, 45.33, 206/432, 497, 610, 611, 613; 229/52 A, 52 B, 52 BC; 383/17

[56] References Cited

U.S. PATENT DOCUMENTS

| | | | |
|---|---|---|---|
| 2,343,222 | 2/1944 | Nelson | 206/613 |
| 2,470,388 | 5/1949 | Ball | 229/17 R |
| 3,112,856 | 12/1963 | MacIntosh | 229/52 B |
| 3,216,645 | 11/1965 | Hemann | 206/52 B |
| 3,217,874 | 11/1965 | Potter | 206/45.33 |
| 3,477,564 | 11/1969 | Crabtree . | |
| 3,532,214 | 10/1970 | Helms . | |
| 3,660,961 | 5/1972 | Ganz . | |
| 3,756,397 | 9/1973 | Ganz | 206/45.33 |
| 3,817,373 | 6/1974 | Samsing . | |
| 3,834,525 | 9/1974 | Morgese et al. | 206/432 |
| 4,077,516 | 3/1978 | Duerr | 206/497 |
| 4,156,493 | 5/1979 | Julius | 206/613 |
| 4,291,806 | 9/1981 | Austin | 206/611 |
| 4,296,861 | 10/1981 | Barrash | 206/428 |
| 4,420,080 | 12/1983 | Nakamura | 206/613 |

*Primary Examiner*—Jimmy G. Foster
*Attorney, Agent, or Firm*—Omri M. Behr

[57] ABSTRACT

A cluster package comprising at least one articles, a wrap of sheet material enclosing the article therein, and a generally rectangular reinforement patch affixed to a portion of the wrap. The reinforcement patch has a pair of openings defined therein in spaced relation to each other. These openings may serve as fingerholes for the engagement with fingers for the transportation and/or handling of the cluster package.

3 Claims, 4 Drawing Sheets

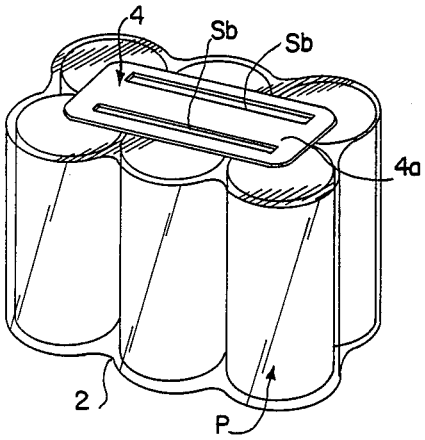
FIG. 7
FIG. 8
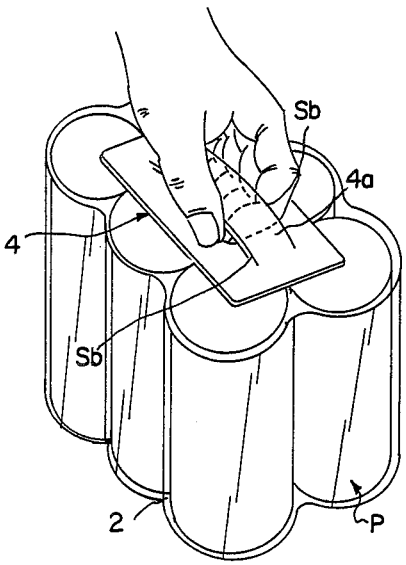
FIG. 9
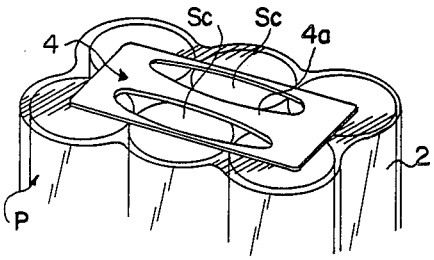
FIG. 10
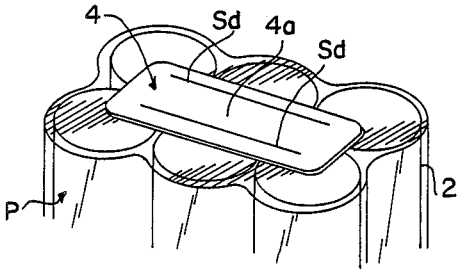

CLUSTER PACKAGE CONSTRUCTION WITH REINFORCING AND TEAR STRUCTURE

This application is a continuation of application Ser. No. 682,323 filed Dec. 17, 1984 now abandoned.

BACKGROUND OF THE INVENTION

The present invention relates to a cluster package construction wherein at least one articles is packaged by a wrap of sheet material.

It is not a recent development to package consumer products in clusters of four, six, or eight or more. Canned beverages are, in most cases, packaged in a cluster of six in two rows with three cans in each row. Even fruits such as apples are also packaged in a unit of two, three, or four or more.

As regards the prior art cluster package constructions, reference may be had to any one of the U.S. Pat. Nos. 3,477,564, patented Nov. 11, 1969; 3,532,214, patented Oct. 6, 1970; 3,66O,961, patented May 9, 1972; 3,817,373, patented June 18, 1974; and 3,834,525, patented Sept. 10, 1974.

U.S. Pat. No. 3,477,564 discloses a shrink-wrapped cluster package comprising six similar cylindrican cans in two parallel rows with three cans in each row, and at least a generally plate-like, molded positioner enclosed together with the cans and positioned on the tops of the cans. The positioner is described as including a sheet of generally rectangular overall configuration with a pair of integrally molded depressions formed therein and spaced from each other along the longitudinal centerline of the sheet. Each depression extends into the interior of the package between a group of four adjacent cans. An outerwrap of flexible transparent film is disposed around the cans and the positioner to maintain these elements in assembled relationship. A finger grip opening is located in the bottom wall of each depression in the positioner, and portions in the outerwrap permit access to the finger grip openings so that the package can be handled easily.

U.S. Pat. No. 3,532,214 discloses a similar package utilizing a positioner having a plurality of partitioning means formed integrally therewith. The positioner with the partitioning means is made of paperboard with the partitioning means serving to avoid any possible direct contact between the adjacent two beverage bottles packaged.

U.S. Pat. No. 3,817,373 discloses a similar package utilizing a cradle for supporting the articles from below and also for partitioning pairs of the articles from each other, which cradle is enclosed within the outerwrap together with the articles.

U.S. Pat. No. 3,834,525 discloses a 2×3 array of cyoindrical beverage cans arapped with a heat-shrunk film which has a top region lying above the tops of the beverage cans formed with a pair of parallel and spaced slits. Each of the spaced slits extends in a direction perpendicular to the longitudinal sense of the shape of the top region and between the adjoining can pairs, and when the thumb and middle finger are inserted at the central void of the cluster of the beverage cans and when these fingers are subsequently brought together while lifting, a central strap portions of the top region defined between these slits stretches slightly under the pendulous weight of the package, allowing all remaining fingers to be inserted under the handle, which is then served by the central strap portion.

In the last mentioned U.S. patent, reference has been made to the similar cluster package wherein the top region of the wrap of heat-shrunk film enclosing the beverage cans is formed with a pair of spaced fingerholes instead of the spaced slits, which fingerholes are said to be aligned with the central void ins the cluster of the beverage cans.

Except for the cluster package disclosed in any one of U.S. Pat. Nos. 3,66O,961 and 3,834,525, it has been found that any of the positioner and the cradle used in the prior art cluster packages is complicated in shape and structure and, the use thereof appears not only to make the packaging process complicated, time-consuming and expensive, but also to make the resultant cluster package expensive to manufacture.

On the other hand, since the cluster package according to any one of U.S. Pat. Nos. 3,660,961 and 3,834,525 does not make use of any reinforcement, it appears that the material for the wrap film is limited for that central strap portion of the wrap film or a portion of the wrap film between the fingerholes to be utilizeable as a handle or finger grip. In other words, unless the material for the wrap film is carefully selected, the strap portion or that portion of the wrap film between the fingerholes will readily break or cut when the cluster package is lifted.

SUMMARY OF THE INVENTION

The present invention has been developed with a view to substantially eliminating the disadvantages and inconveniences inherent in the prior art cluster package and has for its essential object to provide an improved cluster package wherein any finger grip portion or strap portion of the wrap film enclosing the cluster of consumer products will not break or cut even when it is lifted for the transportation from one place to another, for example, from a supermarket shelf to a paying counter.

Another object of the present invention is to provide an improved cluster package of the type referred to above which does not incur the increase of the price of the consumer goods packaged thereby.

A further object of the present invention is to provide an improved cluster package of the type referred to above, which can be put into practice with no slightest modification required to the existing packaging process as well as the exiting packaging machine.

According to the present invention, these objects can readily be accomplished by providing the cluster package with a reinforcement patch made of a sheet of cardboard, plastic material or pliable metallic foil or any other suitable material which is preferably hard to tear under the pendulous weight of the package. The reinforcement patch, generally rectangular in shape, has a pair of spaced openings defined therein accessible to the fingers of a customer purchasing the cluster package and is affixed to a portion of the wrap film enclosing the product or products Preferably, the reinforcement patch has one surface formed with a layer of adhesive material so that it can be affixed to the wrap film at any time and in any manner as desired or required. This reinforcement patch serves not only to strengthen what corresponds in function to the strap or finger grip portion of the wrap film, but also to provide a handle portion between the openings for the access to the hand of the customer.

In alignment with the openings in the reinforcement patch affixed to the wrap film, the wrap film is preferably provided with respective perforations.

Advantageously, the rennforcement patch used according to the present invention need not be prepared in many designs and/or sizes depending on the size of the cluster package. In other words, regardless of whether the cluster package is bulky or whether the cluster package is small in size, the reinforcement patch of a fiven size according to the present invention can be utilized.

The opposite sirface of the reinforcement patch opposite to the adhesive layer may be used to support advertisements, bar codes, the manufacturer's designation or any suitable description or information printed thereon.

In the practice of the present invention, the product or products to be packaged ar not limited to the beverage cans, but may be fruits, root vegetables or products in any suitable containers.

BRIEF DESCRIPTION OF THE ACCOMPANYING DRAWINGS

These and other objects and features of the present invention will readily become clear from the following description taken in conjunction with some preferred embodiments thereof with reference to the accompanying drawings, in which:

FIGS. 6 to 12 are perspective views of the essential portion of the cluster package according to fifth to eleventh preferred embodiments of the present invention, respectively.

DETAILED DESCRIPTION OF THE EMBODIMENTS

Figure 1:
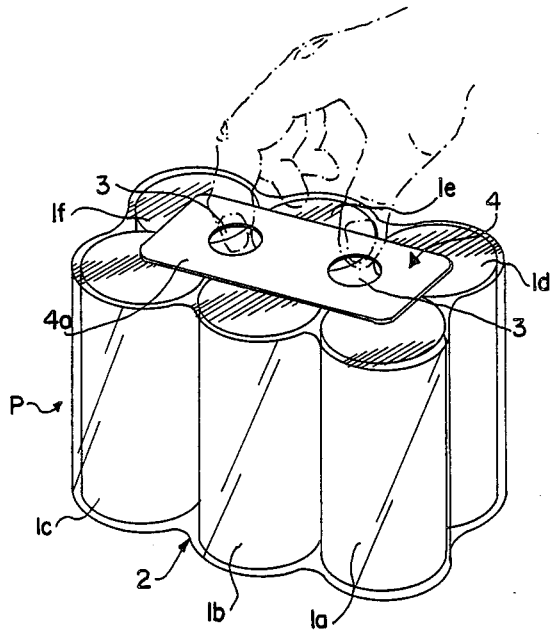
FIG. 1 is a perspective view of a cluster package according to a first preferred embodiment of the present invention.

Before the description of the preferred embodiments of the present invention proceeds, it is to be noted that like parts are designated by like reference numerals throughout the accompanying drawings for the sake of better and ready understanding of the present invention. It is also to be noted that the present invention will be shown and described in connection with a shrink-package of six similar cylindrical beverage containers in two parallel rows with three beverage containers in each row, which is generally known in the trade as the "2×3 six-pack" of beverage cans, although the concept of the present invention can be equally applicable to any film package of at least one article of a nature that is desired or required to have a handy means for the carriage and/or handling of such film package.

Referring first to FIG. 1, a plurality of similar articles, for example, cylindrical beverage cans 1*a* to 1*f*, are shown as arranged in two rows with three cans 1*a* to 1*c*, or 1*d* to 1*f*, in each row and are wrapped by a heat-shrunk, transparent plastic film 2 to form a "2×3" cluster package P. The wrapping of the cylindrical beverage cans 1*a* to 1*f* to form the shrink-wrapped "2×3" cluster package P may be carried out by the use of any known method. For example, the cluster package P may be formed by enclosing a "2×3" array of cylindrical beverage cans with a web of heatshrinkable plastic film with its opposite ends held in overlapping relation to each other at, for example, the bottoms of the beverage cans, which overlapping opposite ends are to be bonded by fusion or by the use of a bonding agent to each other during or subsequent to the heat-treatment for shrinking the film. Another method to form the cluster package P would be to package the cylndrical beverage cans into a bag of heat-shrinkable plastic film so as to render the beverage cans to be arranged in a "2×3" array within the bag and then to apply the heat-treatment to cause the bag to be heat-shrunk. Where the heat-shrinkable bag is used as hereinabove described, the mouth of the bag through which the beverage cans have been packaged into the bag may be sealed by fusion-bonding, or may not be sealed because the opening of the bag mouth, when such bag is heat-shrunk, reduces to such a value that, unless such bag is torn off or punctured, any one of the packaged beverage cans can no longer be removed out of the heat-shrunk bag. A heat-shrinkable plastic tubing may supersede the heat-shrinkable bag if desired.

Furthermore, such a packaging method as disclosed by R. H. Ganz in his U.S. Pat. No. 3,66O,961, patented May 9, 1972, may also be employed together with the packaging machine disclosed therein, in the practice of the present invention. In any event, since the particular manner by which the beverage cans or any other articles are packaged does not constitute the subject matter of the present invention, the details thereof will not be herein discussed for the sake of brevity and it suffices to say that, so far as the illustrated embodiments are concerned, the heat-shrunk film 2 forming the shrink-wrapped cluster package P has generally flat top and bottom regions overlaying the tops and bottoms, respectively, of the 2×3 array of the beverage cans 1*a* to 1*f*, a pair of opposite side regions each on one side of the adjacent row of the beverage cans 1*a* to 1*c*, or 1*d* to 1*f*, remote from the other row of the beverage cans 1*d* to 1*f*, or 1*a* to 1*c*, and a pair of opposite end regions adjacent the can pairs 1*a*–1*d* and 1*c*–1*f*, respectively. It is also to be noted that, with the beverage cans 1*a* to 1*f* so clustered in the "2×3" array, the cluster has central voids each defined between a group of four beverage cans 1*a*-1*b*-1*d*-1*e*, or 1*b*-1*c*-1*e*-1*f*, and extending in parallel to the longitudinal axis of the beverage cans.

Referring still to FIG. 1, and in accordance with the teachings of the present invention, the 2×3 cluster package P is provided with a generally rectangular reinforcement jpatch 4 affixed to, for example, the top region of the film 2 with the longitudinal axis of said reinforcement patch 4 held in alignment with the longitudinal sense of the top region of the film 2. The reinforcement patch 4 is in the form of a sheet member made of plastics or paper, either natural or synthetic, and is applied to the top region of the film 2 by the use of any suitable bonding agent or adhesive material. Where the reinforcement jpatch 4 is made of a heat-shrinkable plastic material, it may be fusion-bonded to the top region of the film 2 by the utilization of the heat-fusible property of one or both of the film 2 and the reinforcement patch 4. However, the reinforcement patch 4 is preferred to have one surface coated with an adhesive material so that, after the formation of the cluster package P, it can be exteriorly affixed to the top region of the film 2.

The reinforcement patch 4 has a pair of openings defined therein in spaced relation to each other, which openings cooperate with each other to provide a handle area 4*a* positioned intermediately therebetween for the access to the hand of a customer purchasing the cluster package of the beverage cans. So far shown in FIG. 1, these openings defined in the reinforcement patch 4 comprise respective circular holes 3 defined therein so as to lie in alignment with the longitudinal sense of the reinforcement patch 4 and spaced a suitable distance from each other. These circular holes 3, which serve as respective fingerholes, are used to receive the thumb and index finger therethrough for the purpose which will become clear from the subsequent description.

The reinforcement patch 4 having the circular holes 3 defined therein is so applied to the top region of the heat-shrunk film 2 as to permit the circular holes 3 to be aligned with the respective central voids in the cluster of the beverage cans. In the practice of the present invention with the beverage cans, portions of the top region of the film 2 which are aligned with the respective central voids and which will be aligned with the circular holes 3 in the reinforcement patch 4 when the latter is applied to the top region of the film 2 are preferably perforated to facilitate the ready insertion of the thumb and index finger. Thus, when the customer desires to carry the cluster package P of the beverage cans, no puncturing of the heat-shrunk film 2 is necessary to derive a secure lifting of the package p.

Figure 2:
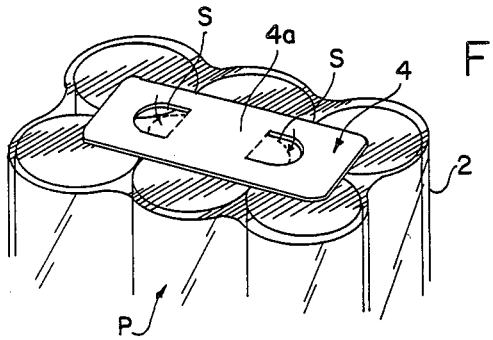
FIGS. 2 to 4 are perspective views of an essential portion of the cluster package according to second to fourth preferred embodiments of the present invention, respectively.

In the embodiment shown in FIG. 2, the openings defined in the reinforcement patch 4 comprise generally U-shaped slits S leaving correspondingly U-shaped tabs which are, unless the thumb and index finger are inserted so as to bend the tabs inwardly of the central voids as shown by the arrows, held in flush with the remaining portion of the reinforcement patch 4.

Preferably, generally U-shaped cuts one for each of the U-shaped slits S is defined in that portions of the top region of the film 2 which are aligned with the respective central voids and also with the U-shaped slits S for facilitating the ready insertion of the thumb and index finger to rupture the film 2.

Figure 3:
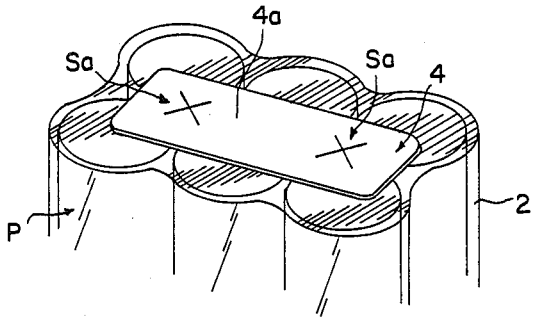

In the embodiment shown in FIG. 3, the openings in the reinforcement patch 4 comprise respective X-shaped line-cuts Sa which, when the thumb and index finger are pierced through the respective points of intersection of the line-cuts Sa, that is, the respective central areas of the shape of a figure "X" assumed by the line-cuts Sa, provide generally rectangular perforations that are aligned with the respective central voids in the cluster. In the case of this embodiment, corresponding X-shaped line-cuts are also formed on that portions of the top region of the film 2 which are aligned with the respective central voids and also with the respective X-shaped line-cuts Sa.

Figure 4:
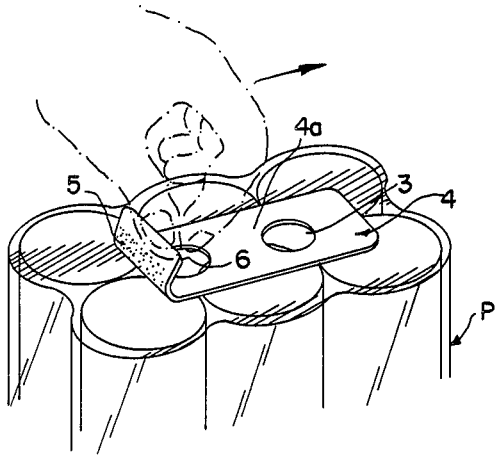
Figure 5:
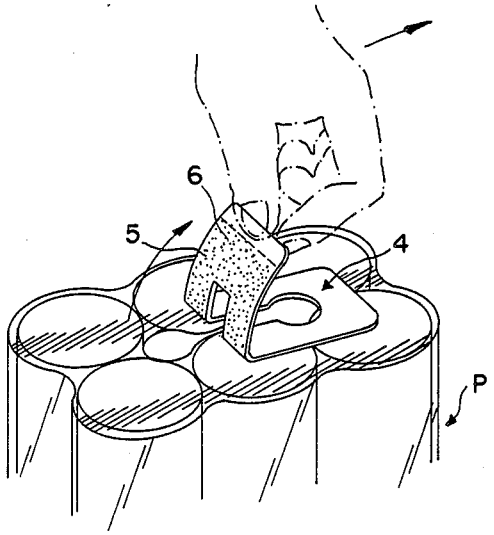
FIG. 5 is a perspective view of the essential portion of the cluster package shown in FIG. 4, showing the manner in which a reinforcement patch is peeled.

The embodiment shown in FIGS. 4 and 5 is similar to that shown in and described with reference to FIG. 1, it being, however, that the difference resides in that, in the embodiment shown in FIGS. 4 and 5, the reinforcement patch 4 has the layer 5 of adhesive material applied to only a portion of said one surface thereof, leaving a non-adhesive area 6 adjacent one end of said reinforcement patch 4.

The cluster package P according to the embodiment shown in and described with reference to FIGS. 4 and 5 is advantgeous in that, when the customer having purchased the cluster package of the beverage cans desire to remove one or two of the beverage cans out of the package, he or she need not endeavour to tear off the film 2, but is simply required to peel the reinforcement patch 4 off the top region of the film 2 to tear the film 2. As is well known to those skilled in the art, if the reinforcement patch 4 were to be completely sticked to the cluster package, the customer will be embarrassed where to peel the reinforcement patch. However, the presence of the nonadhesive area 5 in the reinforcement patch 4 provides a tab by which the reinforcement patch 4 substantially firmly adhering to the top region of the heat-shrunk film 2 can readily be peeled off.

The tearing of the film 2 following the peel-off of the reinforcement patch 4 can advantageously be facilitated if at least one cut is formed along the peripheral lip region defining one of the perforations in the top region of the heat-shrunk film 2 in alignment with the respective central void in the cluster of the beverage cans. As is well known to those skilled in the art, the polyethylene film which is a popular heat-shrinkable material may be hard to tear, but can readily be torn off if even the slightest cut is present somewhere along the peripheral edge of such polyethylene film. However, as a matter of practice, where one or both of the perforations formed in the top region of the film 2 in alignment with the central voids and also in alignment with the openings in the reinforcement patch 4 have an acute-angled peripheral edge, the cut or cuts which ultimately provide the leading end of the line of breakage need not be provided in the film 2.

FIG. 5 illustrates how that portion of the film 2 which is covered by the reinforcement patch 4 and located between the central voids in the cluster is peeled off together with the reinforcement patch 4 shown as being peeled halfway with the non-adhesive area 6 picked between the tumb and index finger.

Figure 6:
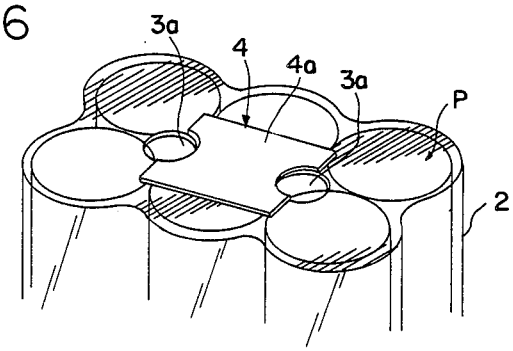

In the embodiment shown in FIG. 6, the openings in the reinforcement patch 4 comprise generally U-shaped cutouts 3*a* cut inwardly of the reinforcement patch 4 from the respective ends.

In all of the foregoing embodiments shown in and described with reference to FIGS. 1 to 6, the handle area 4*a* between the openings in the reinforcement patch 4 serves not only as a handle accessible to the thumb and index finger, but also as a reinforcement which strengthens that portion of the top region of the film 2 which is covered by the handle area 4*a*. Accordingly, as compared with the cluster package with no reinforcement patch, the cluster package P with the reinforcement patch 4 affixed thereto according to the present invention can carry a substantial weight of the articles packaged because of the employment of the reinforcement patch 4.

In the embodiment shown in FIG. 7, the openings defined in the reinforcement patch 4 comprise slits Sb spaced a distance from each other and positioned adjacent the opposite side edges of the reinforcement patch 4 so as to extend in parallel relation to the longitudinal sense of the reinforcement patch 4. As shown in FIG. 8, when the cluster package P is to be carried away, some or all of the fingers, except for the thumb, of the customer's hand are inserted into one of the slits Sb to pass beneath the handle area 4*a* and then to emerge outwardly through the other of the slits Sb, and the cluster package P is then lifted for the transportation. In the practice of the embodiment shown in FIGS. 7 and 8, since each of the slits Sb extending longitudinally of the reinforcement patch 4 may extend clear of any one of the central voids in the cluster of the beverage cans, the top region of the film 2 is formed with a pair of spaced slits at respective locations aligned exactly with the slits Sb in the reinforcement patch 4.

Instead of the longitudinally extending slits Sb shown in and described with reference to FIGS. 7 and 8, either generally elongated slots Sc as shown in FIG. 9, or longitudinally extending line-cuts Sd as shown in FIG. 10 may be employed. In either case, the top region of the film 2 is formed with a pair of spaced slits at respective locations aligned with the slots Sc or the line-cuts Sd.

Figure 11:
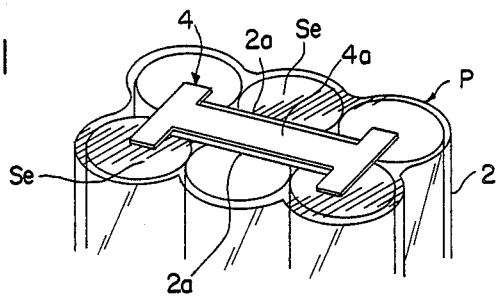

In the embodiment shown in FIG. 11, the openings in the reinforcementlpatch 4 comprise generally U-shaped recesses Se each extending inwardly of the reinforcement patch 4 from the respective side edge and defined therein so as to leave the reinforcement patch 4 to assume the shape of a fingure "H", the vertical bars of the shape of the figure being occupied by the opposite ends of the r inforcement patch 4 while the horizontal bar of the shape of the figure is occupied by the handle area 4*a* which, in the embodiment of FIG. 11, extends in a direction longitudinally of the reinforcement patch 4. At respective locations on the opposite sides of the handle area 4*a*, the top region of the film 2 is formed with a pair of spaced slits or line-cuts 2*a* to permit some or all of the fingers, except for the thumb, to be inserted therethrough to extend underbeath the handle area 4*a* substantially as shown in FIG. 8.

Figure 12:
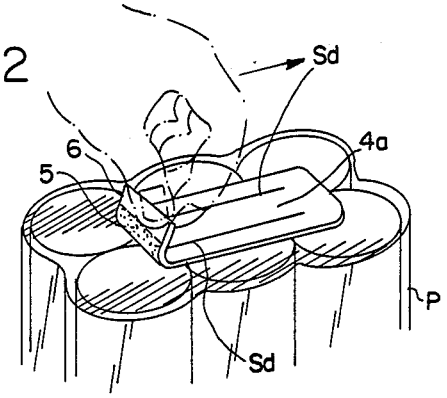
Figure 13:
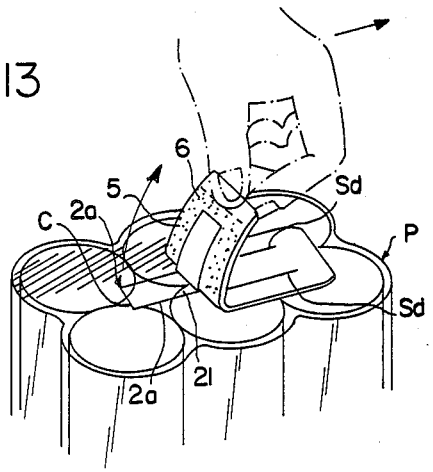
FIG. 13 is a perspective view of the essential portion of the cluster package shown in FIG. 12, showing the manner in which the reinforcement patch is peeled.

FIGS. 12 and 13 illustrate the embodiment wherein the concept of the present invention embodied in the embodiment shown in FIGS. 4 and 5 is applied to the embodiment shown in any one of FIGS. 7 and 8, FIG. 9 and FIG. 10. As can readily be understood from FIGS. 12 and 13, the reinforcement patch 4 has the adhesive layer 5 and the non-adhesive area 6 both defined on the same surface thereof, the non-adhesive area 6 being located adjacent one end of said reinforcement patch 4. In order for the reinforcement patch 4 to tear the film 2 partially as the reinforcement patch 4 is peeled off from the top region of the film 2, one or both of the slits or line-cuts 2*a* formed on the top region of the film in alignment with the line-cuts Sd are provided with cuts C which provide the starting end of the line of breakage when the reinforcement patch 4 is actually peeled off.

In any one of the foregoing embodiments show in and described with reference to FIGS. 1 to 13, the reinforcement patch 4 is affixed to the cluster package P preferably subsequent to the heat-treatment to shrink the film 2. However, where the film 2 is made of any other sheet material such as, for example, cellophane, than that having a hear-shrinkable property, the reinforcement patch 4 may be affixed to the top region of the film 2 either prior to or subsequent to the wrapping of the cluster of the beverage cans together with the film. Especially in the latter case, the reinforcement patch 4 may be affixed either exteriorly or interiorly to the top region of the film 2.

The perforations to be formed on the top region of the film 2 in alignment with the openings in the reinforcement patch 4 can be readily formed by the utilization of one or two cutters each having a shape complemental to the shape of the openings in the reinforcement patch 4. By way of example, the openings in the reinforcement patch 4 and the perforations in the top region of the film 2 aligned with such openings in the reinforcement patch 4 can be both simultaneously formed by the use of a heated cutter or cutters. Where any possible damage to the articles packaged should be avoided, it can readily be accomplished by lifting the top region of the film 2, together with the reinforcement patch 4 adhering thereto, above the tops of the beverage cans by the use of a suction cup of a type having a heated cutter or cutters housed therein and then to apply the heated cutters.

Although the present invention has fully been described in connection with the preferred embodiments thereof with reference to the accompanying drawings, it is to be noted that various changes and modifications are readily conceivable to those skilled in the art. By way of example, the outer surface of the reinforcement patch 4 opposite to the film 2 may be used to support descriptions and/or advertisement printed thereon, or a bar code printed or bonded thereto to show the price, the date of manufacture and/or the manufacturer's designation or any other suitable information.

Moreover, in the case of the embodiments particularly shown in FIGS. 7 to 13, one or both of the openings in the reinforcement patch 4 and the perforations in the top region of the film 2 aligned with such openings in the reinforcement patch 4 may be formed by a row of perforations formed by the use of, for example, a roulette.

Furthermore, the articles to be clusterpackaged may not be limited to the beverage cans such as referred to in describing the embodiments of the present invention, any other articles may be employed provided that, when they are clustered, the cluster of such articles has at least two derpessions such as the central voids referred to hereinbefore. This is particularly true in the case of the embodiments shown in and described with reference to FIGS. 1 to 6. The shape of the cluster package P may not also be limited to that shown and described.

Accordingly, such changes and modifications are to be understood as included within the true scope of the present invention as defined by the appended claims, unless they depart therefrom.

I claim:

1. A cluster package comprising:

at least one article, a wrap of heat shrunk plastic sheet material enclosing said article, means for opening said cluster package comprising in said wrap, at least one pair of spaced slit-formed perforations defined therein said perforations having a length less than the combined dimension of the wrapped articles measured along a line parallel to the line of said perforations, said slit-formed perforations extending parallel to each other and at least one perforation in said wrap joining said spaced perforations, said means further comprising a reinforcements patch having adhesive and non-adhesive regions defined on one surface thereof, said adhesive regions of said patch being adhered to the portion of the wrap having the perforations therein, said patch being further oriented in such a manner that the non-adhesive region thereof is located proximate to the said joining perforation, said patch having a pair of elongated parallel openings defined therein in register with the parallel slits in the wrap, whereby when the non-adhesive portion is lifted, permitting the adhesive portion to be peeled from the body of the wrap the segment of the wrap between the joining perforation and the two spaced perforations will remain adhered to the patch whereby a slice begins to be torn from said wrap.

2. A cluster package as claimed in claim 1, wherein said patch has a pair of spaced fingerholes defined therein, in register with the fingerholes in the wrap.

3. A cluster package comprising:

at least one article, a wrap of heat shrunk plastic sheet material enclosing said article, means for opening said cluster package comprising in said wrap at least one pair of spaced finger hole shaped perforations defined therein said perforations having a length less than the combined dimension of the wrapped articles measured along a line parallel to the line of said perforations, and at least one perforation in said wrap joining said spaced perforations, said means further comprising a reinforcement patch having adhesive and non-adhesive regions defined on one surface thereof, said adhesive regions of said patch being adhered to the portion of the wrap having the perforations therein, said patch being further oriented in such a manner that the non-adhesive region thereof is located proximate to the said joining perforation, whereby when the non-adhesive portion is lifted, permitting the adhesive portion to be peeled from the body of the wrap the segment of the wrap between the joining perforation and the two spaced perforations will remain adhered to the patch whereby a slice begins to be torn from said wrap.

* * * * *